US009468291B2

(12) United States Patent
Nilsen

(10) Patent No.: US 9,468,291 B2
(45) Date of Patent: Oct. 18, 2016

(54) COMBINATION SHEET MUSIC STAND AND DRY ERASE BOARD

(71) Applicant: Doreen Ann Nilsen, Edinburg, VA (US)

(72) Inventor: Doreen Ann Nilsen, Edinburg, VA (US)

( * ) Notice: Subject to any disclaimer, the term of this patent is extended or adjusted under 35 U.S.C. 154(b) by 0 days.

(21) Appl. No.: 14/810,416

(22) Filed: Jul. 27, 2015

(65) Prior Publication Data

US 2016/0058175 A1 Mar. 3, 2016

Related U.S. Application Data

(60) Provisional application No. 62/044,163, filed on Aug. 29, 2014.

(51) Int. Cl.

| | |
|---|---|
| ***A47B 97/04*** | (2006.01) |
| ***A47B 23/00*** | (2006.01) |
| ***A47B 23/06*** | (2006.01) |
| ***A47B 23/02*** | (2006.01) |

(52) U.S. Cl.

CPC ..... *A47B 23/004* (2013.01); *A47B 23/02* (2013.01); *A47B 23/06* (2013.01)

(58) Field of Classification Search

CPC ..... G10C 3/00; G10C 3/02; G09B 15/004; A47B 23/004; A47B 23/06; A47B 23/02

See application file for complete search history.

(56) References Cited

U.S. PATENT DOCUMENTS

| | | | | |
|---|---|---|---|---|
| 556,064 | A | 3/1896 | Pepper | |
| 805,221 | A | 11/1905 | Müller | |
| 1,082,639 | A | 12/1913 | Kauffman | |
| 2,105,739 | A | 1/1938 | Jacobs et al. | |
| 2,128,293 | A | 8/1938 | Fitchett | |
| 4,295,408 | A * | 10/1981 | Pasker | G09B 15/004 198/814 |
| 4,582,344 | A * | 4/1986 | Weiss | G10G 7/00 248/447 |
| D340,150 | S | 10/1993 | Tanaka | |
| 6,050,536 | A | 4/2000 | Bicknese | |
| 6,491,277 | B1 | 12/2002 | Chappell et al. | |
| 7,576,272 | B2 * | 8/2009 | Houfek | G10G 7/00 84/180 |
| 7,754,954 | B2 | 7/2010 | Neil | |
| 7,874,842 | B2 | 1/2011 | Beno | |
| 2013/0323707 | A1 | 12/2013 | Lyons et al. | |

FOREIGN PATENT DOCUMENTS

| | | |
|---|---|---|
| CN | 201725449 U | 1/2011 |
| DE | 39 28 727 A1 | 3/1991 |

* cited by examiner

*Primary Examiner* — Amy Sterling

(74) *Attorney, Agent, or Firm* — Richard C. Litman

(57) ABSTRACT

The combination sheet music stand and dry erase board is a supplemental sheet music stand for use in combination with a music rack of a conventional piano. The combination sheet music stand and dry erase board includes a planar support having opposed upper and lower ends and opposed front and rear surfaces. The planar support is formed from a transparent material adapted for receiving erasable ink on the front surface thereof. Indicia indicative of at least one musical staff is formed on the rear surface of the planar support, allowing a user to erasably write musical notation directly on the front surface of the planar support. A shelf for supporting sheet music or the like is mounted on the lower end of the planar support. A retaining member is mounted on the upper end of the planar support for suspension from an upper edge of the music rack.

4 Claims, 7 Drawing Sheets

COMBINATION SHEET MUSIC STAND AND DRY ERASE BOARD

CROSS-REFERENCE TO RELATED APPLICATION

This application claims the benefit of U.S. Provisional Patent Application Ser. No. 62/044,163, filed on Aug. 29, 2014.

BACKGROUND OF THE INVENTION

1. Field of the Invention

The present invention relates to music racks associated with keyboard musical instruments, and particularly to a combination sheet music stand and dry erase board used as a supplement to a conventional music rack for a keyboard musical instrument for supporting sheet music or the like.

2. Description of the Related Art

Keyboard musical instruments, such as pianos, organs and the like, are typically equipped with a music rack, positioned above the keyboard, for supporting sheet music. Due to the construction typical of such keyboard musical instruments, particularly pianos, the music rack is typically positioned high, relative to the line of sight of a pianist or a musician, requiring the pianist or the musician to tilt his or her head upward in order to read the music. In addition to being generally uncomfortable, this positioning can hinder the playing of the musical instrument, such as a piano, by children and other people of relatively short stature. Thus, a combination sheet music stand and dry erase board addressing the aforementioned problems is desired.

SUMMARY OF THE INVENTION

The combination sheet music stand and dry erase board is a supplemental sheet music stand for use in combination with a music rack of a conventional piano, other keyboard musical instrument or other suitable musical instruments, for example. The combination sheet music stand and dry erase board includes a planar support having opposed upper and lower ends and opposed front and rear surfaces. The planar support is formed from a transparent material adapted for receiving an erasable ink on the front surface thereof, similar to a conventional dry erase board. Indicia indicative of at least one musical staff is formed on the rear surface of the planar support, allowing a user to eras ably write musical notation directly on the front surface of the planar support.

A shelf is mounted on the lower end of the planar support and extends frontwardly therefrom. The shelf is adapted for supporting sheet music on the sheet music stand. A removable lip is removably secured to the shelf for releasably securing the sheet music thereon. Additionally, a retaining member is mounted on the upper end of the planar support for suspending the planar support from an upper edge of the music rack. The retaining member desirably includes at least one block having a front end portion including a front end and a rear end portion including a rear end, the front end being positioned in opposing relation to the rear end, with a slot being defined in a lower surface of the corresponding block such that the upper end of the planar support is received within the slot.

The rear end portion of the at least one block is positioned adjacent the rear surface of the planar support and the front end portion of the at least one block is positioned adjacent the front surface of the planar support, such that the rear end portion of the at least one block is adapted to support the retaining member on the upper edge of the music rack. Desirably, at least one padded layer is secured to a lower face of the rear end portion of the at least one block.

The retaining member and the removable lip can be made from any suitable type of material, such as wood, a plastic material or the like. The wood or other material can be manufactured in a variety of colors, styles and types, allowing users to match the wood finish to the piano or other keyboard musical instrument or other furniture. It should be understood that the combination sheet music stand and dry erase board can be used in combination with additional articles related to conventional music racks and the like, such as, for example, wedges or the like to assist in preventing unwanted tipping of the music rack under the weight of the sheet music or the additional weight of the combination sheet music stand and dry erase board.

Sheet music, as used herein, can include any of various forms of media on which music is printed, embodied or displayed, such as including but not limited to one or more music sheets, one or more music books, or a display device displaying music, etc. or the like, for example, and should not be construed in a limiting sense. It is important to note that the combination sheet music stand and dry erase board may be used to hold sheet music or any other desired media, article or item, dependent upon the particular needs and desires of the user, and is not intended to be limited solely to the support of sheet music alone.

These and other features of the present invention will become readily apparent upon further review of the following specification and drawings.

BRIEF DESCRIPTION OF THE DRAWINGS

Unless otherwise indicated, similar reference characters denote corresponding features consistently throughout the attached drawings.

DETAILED DESCRIPTION OF THE PREFERRED EMBODIMENTS

Figure 1:
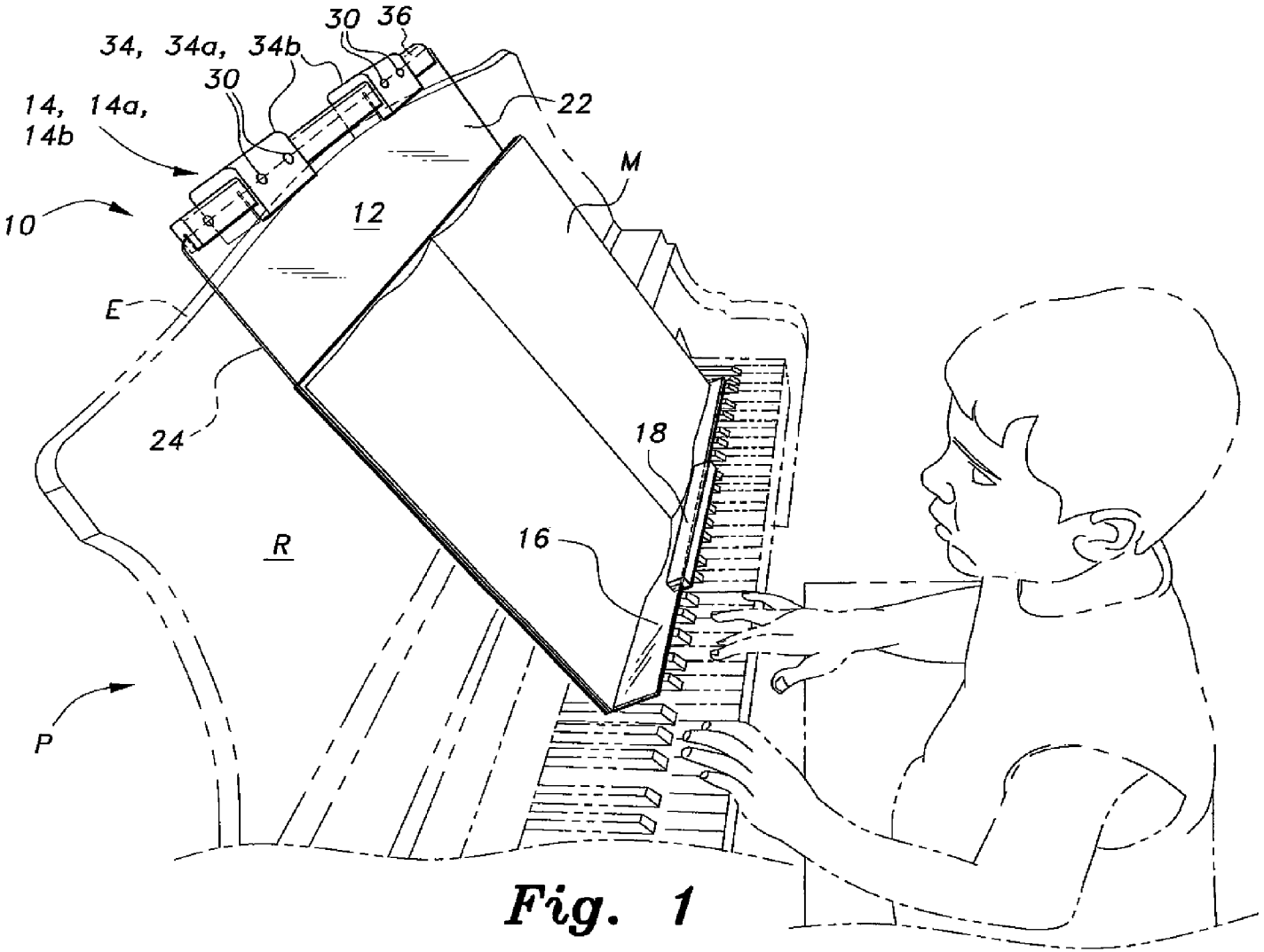
FIG. 1 is an environmental, perspective view of a combination sheet music stand and dry erase board according to the present invention.

The combination sheet music stand and dry erase board 10 is a supplemental sheet music stand for use in combination with a music rack R of a keyboard musical instrument or other suitable musical instrument, such as the exemplary conventional piano P of FIG. 1. FIG. 1 shows the combination sheet music stand and dry erase board 10 suspended from the music rack R of the piano P. It should be understood that the music rack R and the piano P are shown for exemplary purposes only and that the combination sheet music stand and dry erase board 10 can be used as a supplement to any of various conventional music racks, stands or the like, and should not be construed in a limiting sense. Although the combination sheet music stand and dry erase board 10 is described herein primarily for the example of supporting sheet music, it should be understood that the combination sheet music stand and dry erase board 10 may be used to hold sheet music or any other desired media, article or item, dependent upon the particular needs and desires of the user, and is not intended to be limited solely to the support of sheet music alone.

As best shown in the embodiments of FIGS. 1, 2A, 2B, 2C and 3, the combination sheet music stand and dry erase board 10 includes a planar support 12 having opposed upper and lower ends 40, 42, respectively, and opposed front and rear surfaces 22, 24, respectively. The planar support 12 is formed from a transparent material adapted for receiving an erasable ink on the front surface 22 thereof, similar to a conventional dry erase board. Erasable ink as used herein can include any of various erasable inks, dry erase inks, dry erase markers, erasable markers, or the like, for example, and should not be construed in a limiting sense. Any of various suitable types of transparent materials capable of receiving dry erase ink or any other type of erasable ink or erasable marker or the like can be utilized for the planar support 12, such as, for example, poly(methyl methacrylate) (PMMA), as can depend on the use or application, and should not be construed in a limiting sense.

Figure 2A:
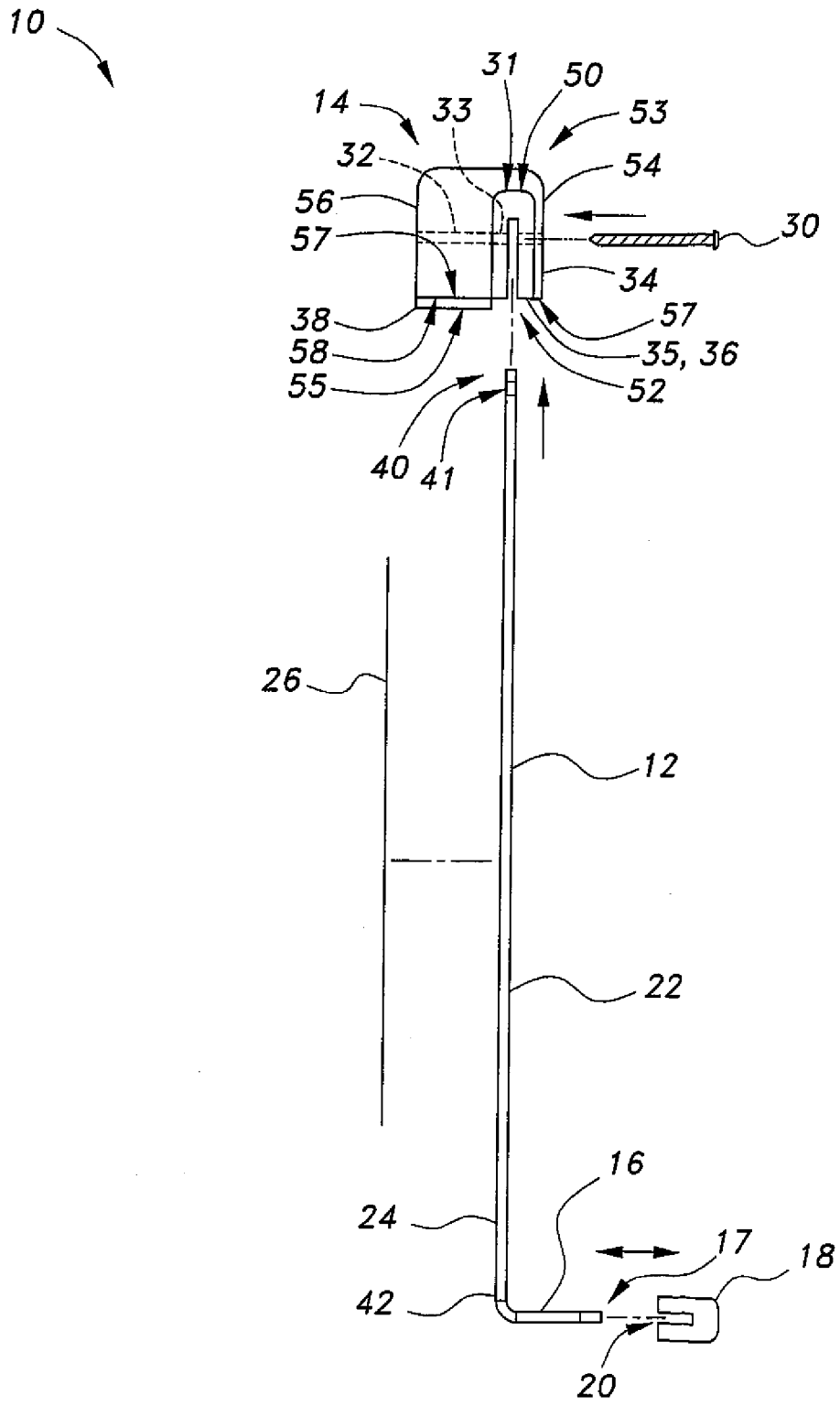
FIG. 2A is a side exploded view of the combination sheet music stand and dry erase board according to the present invention.
Figure 2B:
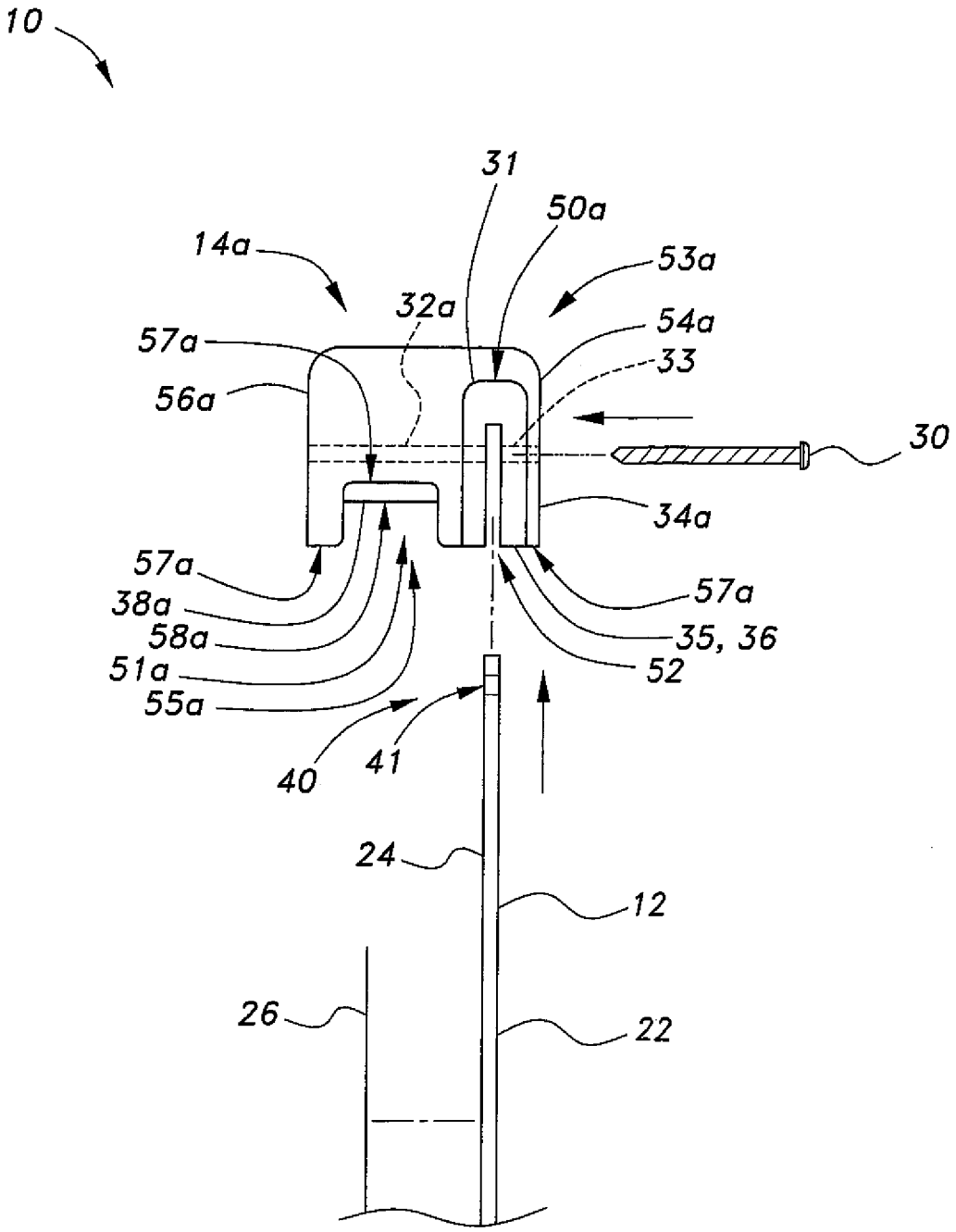
FIG. 2B is a side exploded view of an alternative embodiment of the combination sheet music stand and dry erase board.
Figure 2C:
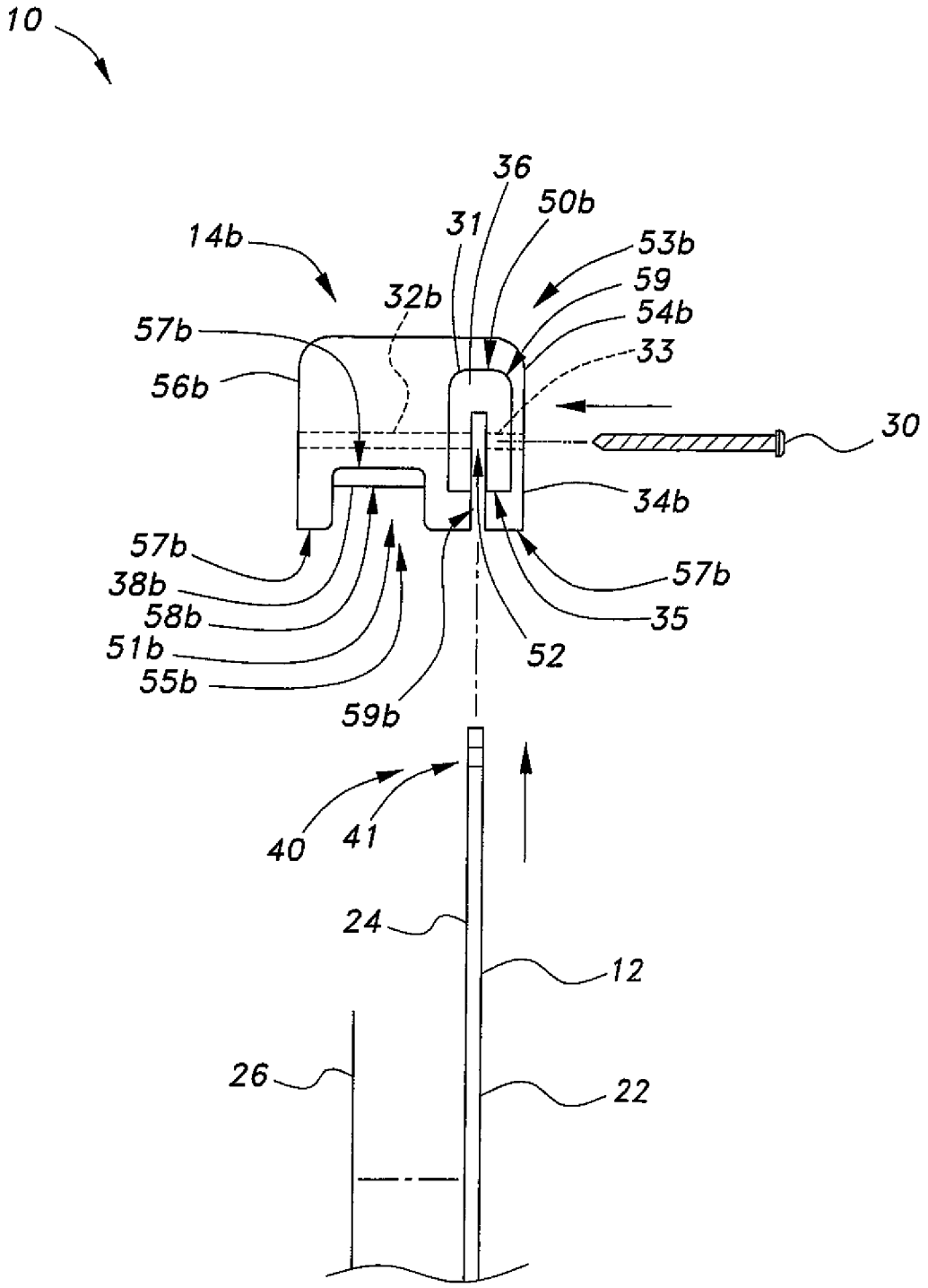
FIG. 2C is a side exploded view of another alternative embodiment of the combination sheet music stand and dry erase board.
Figure 3:
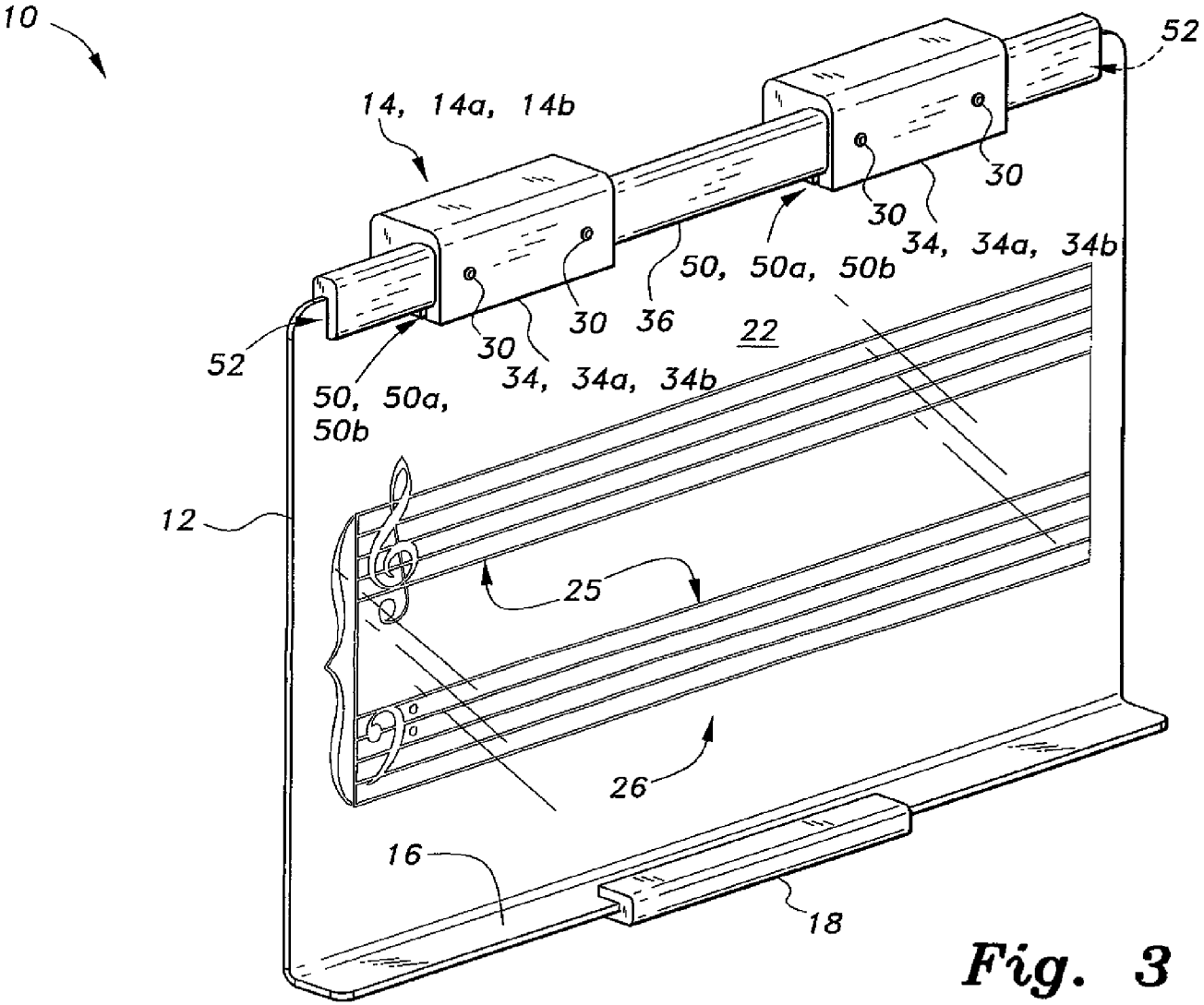
FIG. 3 is a perspective view of the combination sheet music stand and dry erase board of FIG. 1.

As best shown in FIG. 3, indicia 25 indicative of at least one musical staff is formed on the rear surface 24 of the planar support 12, allowing a user to erasably write musical notation or other information directly on the front surface 22 of the planar support 12. As shown in FIGS. 2A, 2B, 2C and 3, the indicia 25 can be in the form of a decal 26 adhered to the rear surface 24 of the planar support 12, although it should be understood that any suitable method of imprinting or otherwise forming the indicia 25 on the rear surface 24 of the planar support 12 can be utilized, as can depend on the use or application, and should not be construed in a limiting sense. As shown in FIG. 3, the indicia 25 can be in the form of a grand staff or the like, for example, although it should be understood that any desired indicia can be used, and should not be construed in a limiting sense.

As best shown in FIG. 1, the combination sheet music stand and dry erase board 10 positions the sheet music lower than a conventional music rack R (i.e., closer to the keys of the piano P or other keyboard musical instrument, for example) and desirably further angles the sheet music towards the pianist or the musician, such as illustrated in FIG. 1, for example. This lower, angled positioning of the sheet music can allow the pianist or the musician to read the music relatively easier than with a conventional music rack R, specifically substantially reducing or substantially removing the need of the pianist or the musician to tilt his or her head upward to see the sheet music. Although the specific dimensions of the planar support 12 can be varied dependent upon the particular needs and desires of the user, as well as on the particular use or application, the planar support 12 is desirably longer than a conventional music rack R, allowing the sheet music to be supported in a lower position, such as relative to the keys of the piano P or other keyboard musical instrument, for example.

Referring to the embodiment of FIGS. 1 and 2A, a shelf 16 is mounted on the lower end 42 of the planar support 12 and extends frontwardly therefrom for supporting sheet music M or the like on the sheet music stand and dry erase board 10. Sheet music as used herein can include any of various forms of media on which music is printed, embodied or displayed, such as including but not limited to one or more music sheets, one or more music books, or a display device displaying music, etc. or the like, for example, and should not be construed in a limiting sense. The shelf 16 can have any desired relative dimensions, as can depend on the use or application, and should not be construed in a limiting sense. Exemplary dimensions for the shelf 16 can include a width (i.e., the width along the horizontal direction in the orientation of FIG. 2A, in a direction extending frontforwardly from the front surface 22 of the planar support 12) of approximately 1.5 inches, for example. And the shelf 16 can include a length that is desirably equal to the length of the planar support 12, which can be, for example, approximately 18 inches. The planar support 12 can have an exemplary thickness of approximately 0.08 inches, for example. A removable lip 18 is removably secured to the shelf 16 for releasably securing the sheet music thereon. As shown, the removable lip 18 is desirably in the form of a block or a bar having a slot 20 defined therein for removably receiving the front edge 17 of the shelf 16.

Continuing with reference to FIGS. 1, 2A, 2B, 2C and 3, additionally, a retaining member 14, 14*a*, 14*b* is mounted on the upper end 40 of the planar support 12 for suspending the planar support 12 from, as well as supporting the planar support 12 on, an upper edge E of the music rack R. The retaining member 14, 14*a*, 14*b* includes at least one block 34, 34*a*, 34*b* and can also include a cross bar 36. The cross bar 36 has an upper end 31 and a lower end 35 and includes a slot 52 in the lower end 35 adapted to receive the upper end 40 of the planar support 12. The at least one block 34, 34*a*, 34*b* has a front end portion 53, 53*a*, 53*b* including a front end 54, 54*a*, 54*b* and a rear end portion 55, 55*a*, 55*b* including a rear end 56, 56*a*, 56*b*, the front end 54, 54*a*, 54*b* being positioned in opposing relation to the rear end 56, 56*a*, 56*b* with a slot 50, 50*a*, 50*b* being defined in a lower surface 57, 57*a*, 57*b* of the corresponding block 34, 34*a*, 34*b* such that the upper end 40 of the planar support 12 is received within the slot 50, 50*a*, 50*b*. The upper end 40 of the planar support 12 can be positioned and received within the slot 50, 50*a*, 50*b* without use of the cross bar 36, and the slot 50, 50*a*, 50*b* can be suitably sized, configured and dimensioned to receive the upper end 40 of the planar support 12 without such use of the cross bar 36, for example. Also, desirably, the upper end 40 of the planar support 12 can be positioned and received within the slot 50, 50*a*, 50*b* in conjunction with the upper end 40 of the planar support 12 also being positioned in the slot 52 of the cross bar 36, for example.

As best shown in FIGS. 2A, 2B, 2C and 3, two such blocks 34, 34*a*, 34*b* are desirably provided, with the blocks 34, 34*a*, 34*b* being mounted on the cross bar 36. The cross bar 36 has the slot 52 defined in the lower end 35 thereof, similar to slots 50, 50*a*, 50*b* of the blocks 34, 34*a*, 34*b* for receiving the upper end 40 of the planar support 12. Slots 50, 50*a*, 50*b* and 52 can be of various suitable configurations, dimensions and sizes, as can depend on the use or application, and should not be construed in a limiting sense.

Also, all or a portion of the slot 50, 50*a*, 50*b* of a corresponding block 34, 34*a*, 34*b* can be desirably configured, dimensioned and sized to correspond to the thickness of planar support 12, to assist in allowing for a relatively secure fit of the planar support 12 within all or the portion of the slot 50, 50*a*, 50*b* of the corresponding block 34, 34*a*, 34*b*. Additionally, all or a portion of the slot 50, 50*a*, 50*b* can be desirably configured to correspond to a size, dimensions and configuration of the cross bar 36 when adapted to be positioned and received in all or a corresponding portion of the slot 50, 50*a*, 50*b*. As illustrated in FIG. 2C, in the retaining member 14*b*, in the block 34*b*, the slot 50*b* has a first upper portion 59 of a first size, configuration and dimensions adapted to receive the cross bar 36 and the slot 50*b* has a second lower portion 59*b* of a second size, configuration and dimensions adapted to receive the upper end 40 of the planar support 12. Further, the slot 52 in the cross bar 36 is desirably sized to correspond to the thickness of planar support 12, to assist in allowing for a relatively secure fit of the planar support 12 within the corresponding slot 52 of the cross bar 36.

As illustrated in FIGS. 2A, 2B and 2C, the rear end portion 55, 55*a*, 55*b* of the at least one block 34, 34*a*, 34*b* is positioned adjacent the rear surface 24 of the planar support 12 and the front end portion 53, 53*a*, 53*b* of the at least one block 34, 34*a*, 34*b* is positioned adjacent the front surface 22 of the planar support 12, such that the rear end portion 55, 55*a*, 55*b* of the at least one block 34, 34*a*, 34*b* is adapted to suspend the retaining member 14, 14*a*, 14*b* from and support the retaining member 14, 14*a*, 14*b* on the upper edge E of the music rack R.

In this regard, in an embodiment of the at least one block 34 of the retaining member 14 in FIG. 2A, a lower face 58 of the lower surface 57 on the rear portion 55 of the at least one block 34 is adapted to engage the upper edge E of the music rack R to suspend therefrom and support thereon the sheet music stand and dry erase board 10. Additionally, as illustrated in FIGS. 2B and 2C, the at least one block 34*a*, 34*b* of the retaining member 14*a*, 14*b* can include a second slot 51*a*, 51*b* formed in a lower face 58*a*, 58*b* of the lower surface 57*a*, 57*b* of the rear end portion 55*a*, 55*b* and adapted to receive therein and engage the upper edge E of the music rack R to suspend therefrom and support thereon the sheet music stand and dry erase board 10. The second slot 51*a*, 51*b* in the at least one block 34*a*, 34*b* can assist in further maintaining support for the sheet music stand and dry erase board 10 on the music rack R. Also, the second slot 51*a*, 51*b* can further assist in maintaining the upper edge E of the music rack R in engaging relation with the block 34*a*, 34*b*. The second slot 51*a*, 51*b* can be of various suitable sizes, configurations and dimensions, as can depend on the use or application, so as to receive within the second slot 51*a*, 51*b* the upper edge E of the music rack R to suspend from and support on the upper edge E of the music rack R the sheet music stand and dry erase board 10.

As illustrated in FIG. 2A, a padded layer 38, such as of foam or other suitable padded material or the like, can be secured to the lower face 58 of the lower surface 57 of the rear end portion 55 of the at least one block 34 for cushioned, frictional engagement of a corresponding block 34 with the upper edge E of the music rack R. Further, as illustrated in FIGS. 2B and 2C, a padded layer 38*a*, 38*b* such as of foam or other suitable padded material or the like, can be secured to at least a portion of the lower face 58*a*, 58*b* of the lower surface 57*a*, 57*b* of the rear end portion 55*a*, 55*b* that is located within the second slot 51*a*, 51*b* of the at least one block 34*a*, 34*b* for cushioned, frictional engagement of a corresponding block 34*a*, 34*b* with the upper edge E of the music rack R when positioned within the second slot 51*a*, 51*b*, for example.

As illustrated in FIGS. 1, 2A, 2B, 2C and 3, blocks 34, 34*a*, 34*b* can be further secured to the planar support 12 by any suitable type of fixture or fastener, such as exemplary screws 30 which engage corresponding passages 32, 32*a*, 32*b* formed through blocks 34, 34*a*, 34*b*, corresponding passages 33 formed through the cross bar 36 and a mating set of apertures 41 formed through the upper end 40 of planar support 12. At least one and, desirably, a plurality of fasteners, such as two fasteners or screws 30, can be used to respectively fasten each corresponding block 34, 34*a*, 34*b* to the planar support 12, such as illustrated in FIGS. 1 and 3, for example. It should be understood that any suitable type of fastener or the like can be used to secure the blocks 34, 34*a*, 34*b* to the planar support 12, as can depend on the use or application, and should not be construed in a limiting sense.

The retaining member 14, 14*a*, 14*b* and the removable lip 18 can be made from any of various suitable types of materials, such as wood, a plastic material, or a combination of suitable materials, or the like. The wood, plastic material or other suitable materials can be manufactured in a variety of colors, styles and types, allowing users to match the wood finish to the piano P or other keyboard instrument or other furniture. It should be understood that the combination sheet music stand and dry erase board 10 can be used in combination with additional articles related to conventional music racks and the like, such as, for example, wedges or the like for assisting in preventing unwanted tipping of music rack R under the weight of the sheet music or the additional weight of the combination sheet music stand and dry erase board 10.

Figure 4A:
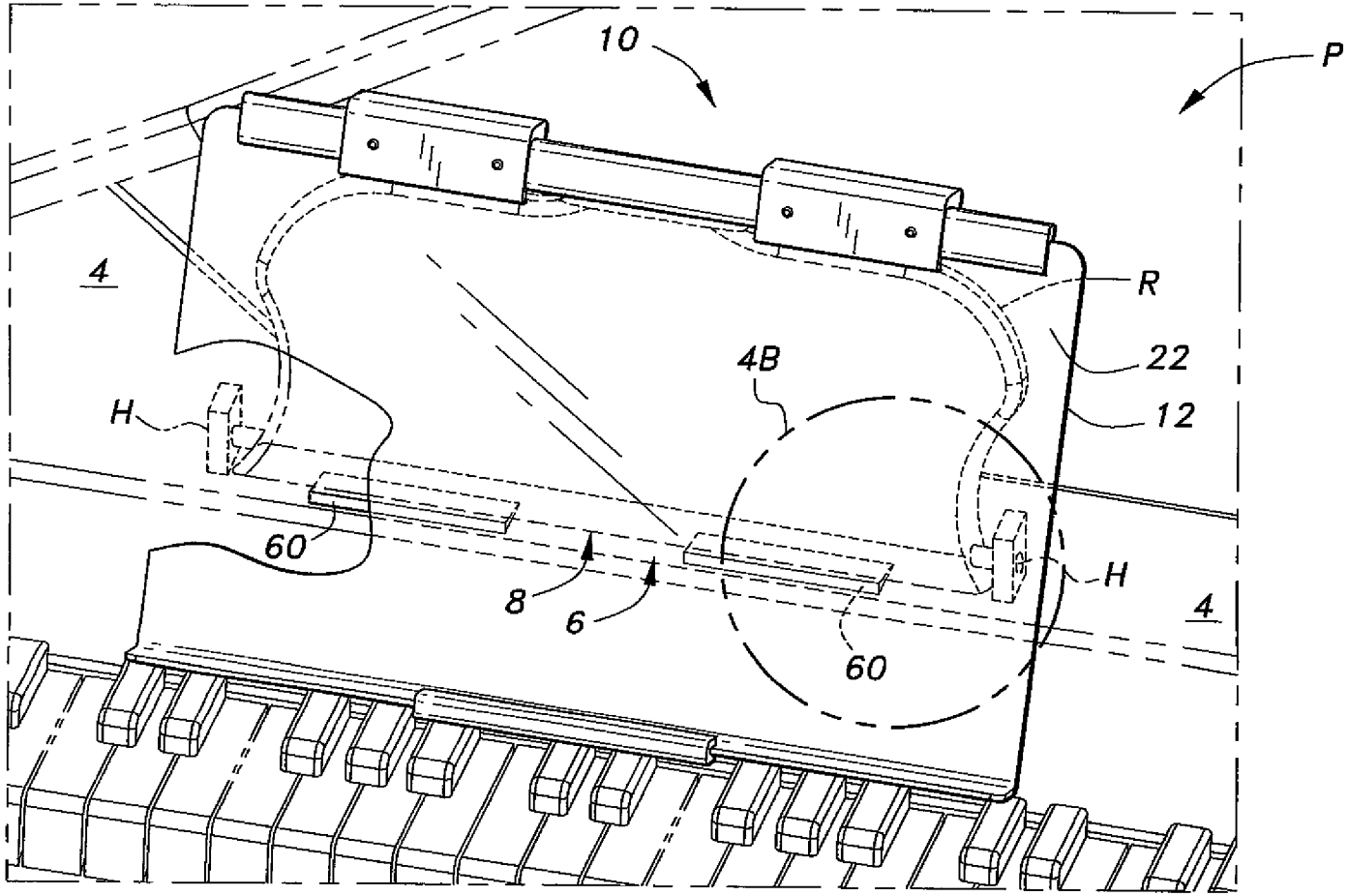
FIG. 4A is an environmental perspective view of a further alternative embodiment of the combination sheet music stand and dry erase board.
Figure 4B:
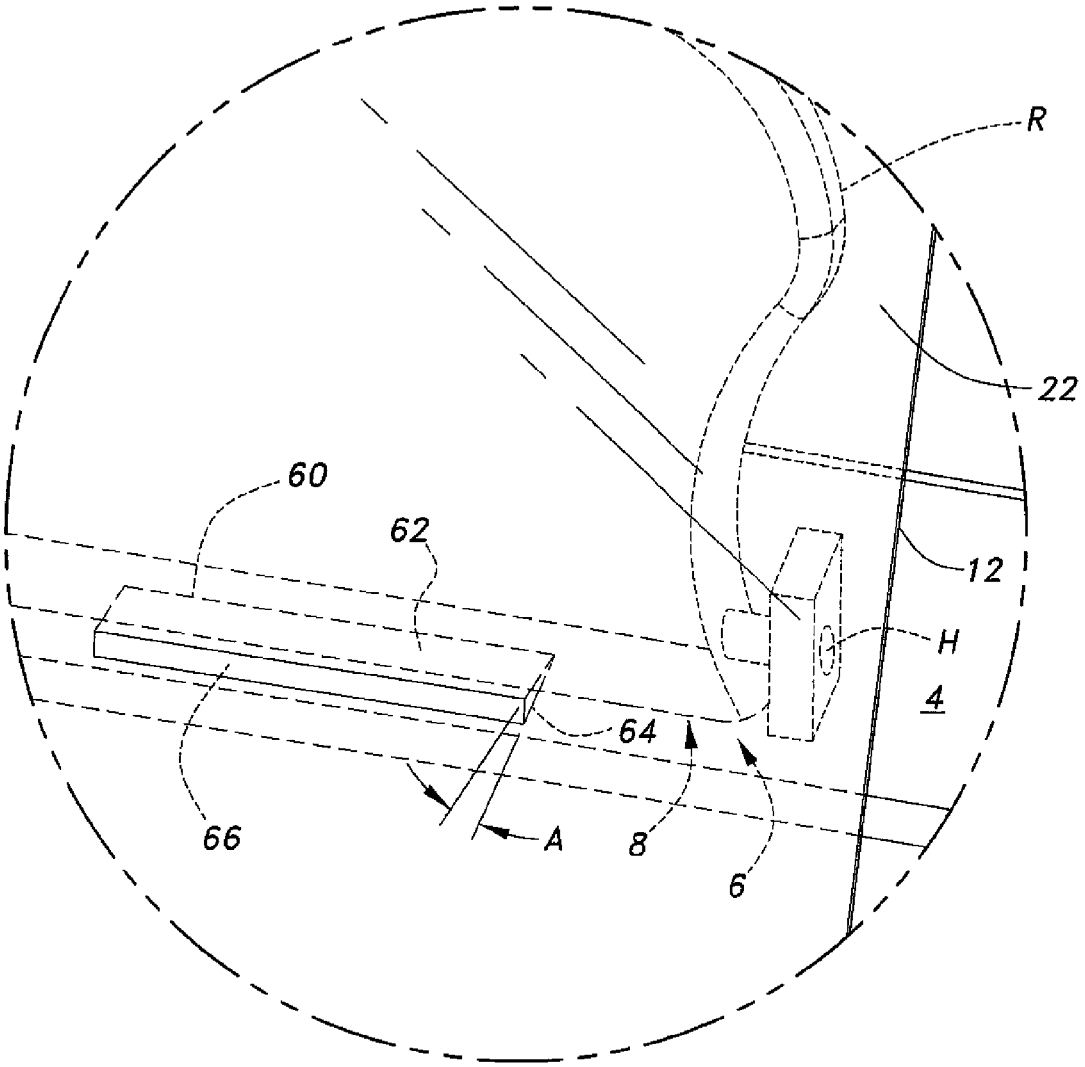
FIG. 4B is an enlarged view of an exemplary wedge of the combination sheet music stand and dry erase board of FIG. 4A.

In this regard, FIGS. 4A and 4B illustrate an embodiment of a kit including a combination sheet music stand and dry erase board 10 and at least one and, desirably, a plurality of a rack bracing members, such as at least one and, desirably, a plurality of wedges 60 that are adapted to be in engaging relation with a surface of a music rack, such as desirably a lower surface 8 of the music rack R. As mentioned, the at least one rack bracing member, such as the at least one wedge 60 or the like, when positioned in engaging relation with the lower surface 8 of the music rack R, such as illustrated in FIG. 4A, for example, can assist in maintaining a substantially stable position of the music rack R so as to substantially reduce a likelihood of unwanted tipping of the music rack R under the weight of the sheet music M when placed on the music rack R, or under the additional weight of the combination sheet music stand and dry erase board 10. In this regard, use of such rack bracing members, such as the at least one wedge 60, can assist in reducing a likelihood of a forward movement of the music rack R, such as on one or more supporting pivotal hinge arrangements H on which the music rack R can be mounted to a suitable musical instrument, such as the piano P.

The at least one wedge 60, as a rack bracing member, can be of a generally wedge shape having a top side 62, a bottom side 64 and a connecting side 66. An angle A, typically an acute angle, is formed by and between the top side 62 and the bottom side 64 of a corresponding wedge 60, and the connecting side 66 connects the top side 62 and the bottom side 64 to form a corresponding wedge 60. The angle A can be of various suitable angles, as can depend on the use or application, and should not be construed in a limiting sense. The angle A inclines the top side 62 and/or the bottom side 64 as can assist in enabling a relatively secure fit when at least one corresponding wedge 60 is positioned in engaging relation with the lower surface of a music rack of a suitable musical instrument, such as the lower surface 8 of the music rack R of the piano P. For example, for the music rack R of the piano P, the at least one wedge 60 can be positioned in a space 6 between the lower surface 8 of a music rack R and a ledge 4 of the piano P, such as can be positioned in the space 6 between the opposing pair of supporting pivotal hinge arrangements H, such that the top side 62 is in substantial engaging relation with the lower surface 8 of the music rack R and the bottom side 64 is in substantial engaging relation with the ledge 4 of the piano P, such as illustrated in FIGS. 4A and 4B, for example.

In this regard, the at least one rack bracing member, such as the at least one wedge 60, when positioned in engaging relation with a music rack of a keyboard musical instrument or other suitable instrument, such as typically at least in engaging relation with a lower surface of the music rack, can assist in maintaining a substantially secure position of the music rack to reduce the likelihood of unwanted tipping of the music rack, such as when the combination sheet music stand and dry erase board 10 is suspended from and supported on the music rack, such as when suspended from and supported on the music rack R. The size, shape and configuration of at least one rack bracing member, such as the at least one wedge 60, can be of various suitable sizes, shapes and configurations, as can depend on the use or application, and should not be construed in a limiting sense.

It is to be understood that the present invention is not limited to the embodiments described above, but encompasses any and all embodiments within the scope of the following claims.

I claim:

1. A combination sheet music stand and dry erase board, comprising:

a planar support having opposed upper and lower ends and opposed front and rear surfaces, said planar support being formed from a transparent material adapted for receiving erasable ink on the front surface thereof, indicia indicative of at least one musical staff being formed on the rear surface;

a shelf mounted on the lower end of said planar support and extending frontwardly therefrom;

a retaining member mounted on the upper end of said planar support for suspending said planar support from an upper edge of a music rack, said retaining member comprises at least one block having a front end portion and a rear end portion, a slot being defined in a lower surface of the at least one block between the front and rear end portions, wherein the upper end of said planar support is received within the slot of the at least one block such that the rear end portion of the at least one block is positioned adjacent the rear surface of said planar support and the front end portion of the at least one block is positioned adjacent the front surface of said planar support, the rear end portion of the at least one block being adapted for supporting the retaining member on the upper edge of the music rack; and a removable lip removably secured to said shelf, whereby said shelf and said removable lip are adapted for releasably supporting sheet music.

2. The combination sheet music stand and dry erase board as recited in claim 1, further comprising a padded layer secured to a lower face of the rear end portion of the at least one block.

3. The combination sheet music stand and dry erase board as recited in claim 2, further comprising a cross bar having a cross bar slot defined in a lower end thereof, the cross bar being received in the slot defined in the lower surface of the at least one block, the upper end of the planar support being received in the cross bar slot.

4. The combination sheet music stand and dry erase board as recited in claim 3, wherein the at least one block comprises a plurality of blocks, each said block being spaced apart from adjacent ones of the plurality of blocks.

* * * * *